United States Patent [19]

Laufer

[11] Patent Number: 4,502,449

[45] Date of Patent: Mar. 5, 1985

[54] FUEL INJECTION PUMP FOR INTERNAL COMBUSTION ENGINES

[75] Inventor: Helmut Laufer, Stuttgart, Fed. Rep. of Germany

[73] Assignee: Robert Bosch GmbH, Stuttgart, Fed. Rep. of Germany

[21] Appl. No.: 379,805

[22] Filed: May 19, 1982

[30] Foreign Application Priority Data

May 30, 1981 [DE] Fed. Rep. of Germany ..... 3121635

[51] Int. Cl.[3] ..... F02M 59/20

[52] U.S. Cl. ..... 123/502

[58] Field of Search ..... 123/502, 501; 417/462

[56] References Cited

U.S. PATENT DOCUMENTS

| | | | |
|---|---|---|---|
| 3,147,746 | 9/1964 | Hofer | 123/502 |
| 4,342,302 | 8/1982 | Straubel et al. | 123/502 |
| 4,353,343 | 10/1982 | Trachte | 123/502 |
| 4,355,621 | 10/1982 | Yasuhara | 123/502 |
| 4,365,605 | 12/1982 | Wessel et al. | 123/502 |
| 4,373,492 | 2/1983 | Konrath et al. | 123/502 |

FOREIGN PATENT DOCUMENTS

| | | | |
|---|---|---|---|
| 92329 | 7/1981 | Japan | 123/502 |

*Primary Examiner*—Magdalen Y. C. Moy

*Attorney, Agent, or Firm*—Edwin E. Greigg

[57] ABSTRACT

A fuel injection pump which has an adjusting piston for the purpose of injection instant adjustment. The adjusting piston has opposite ends defining respective work chambers. The work chambers are supplied with fuel under rpm-dependent pressure from a suction chamber of the fuel injection pump, via respective throttles, and are relieved via respective outflow lines. The outflow cross sections of the outflow lines are controlled in complementary fashion by a control slide of a control valve. The control slide is exposed to a modifiable control pressure derived from the rpm-dependent pressure, and for the peripheral conditions of a cold engine and rpm of the engine below a threshold rpm, the maximum controlled pressure is established by means of a third control valve.

18 Claims, 6 Drawing Figures

4'
15
3'
5'
6'
9'
10'
8'
73
19'
74
71
32'
72
40'
27'
33'
34'
31'
54'
70
29'
26'
30'
43
63
47
52

43'
63
69
75
41
44
43

FUEL INJECTION PUMP FOR INTERNAL COMBUSTION ENGINES

BACKGROUND OF THE INVENTION

The invention relates to a fuel injection pump for an internal combustion engine having an adjusting piston effecting the adjustment of the instant of injection, first and second work chambers which are disposed on opposite ends of the adjusting piston and which communicate via respective first and second inflow lines with a pressure medium supply having a pressure which is varied in accordance with rpm, and a first control valve, which is disposed in either the first inflow line or an outflow line of the first work chamber, for controlling the first work chamber pressure.

In a known injection pump of this type, the outflow line contains not only a work chamber, which includes a restoring spring acting upon the adjusting piston, but also a control slide, which is displaceable by the rpm-dependent pressure of the pressure medium supply such that beyond a predetermined rpm, the control slide closes the outflow line of this work chamber; or, in an alternative realization, the control slide switches a throttle into the outflow line. This switching process is effected in addition to and independently from the first actuation, by means of an expanding-material element upon the attainment of the engine operating temperature. In this known embodiment, a throttle is disposed in the pressure medium inflow to the work chamber.

With this apparatus, the pressure is reduced only in the work chamber containing the restoring spring when the engine is cold and below a fixed final rpm. There are thus very few opportunities for taking into consideration other parameters in adjusting the instant of the injection.

OBJECT AND SUMMARY OF THE INVENTION

The fuel injection pump according to the invention has the advantage over the prior art that by means of the uncoupling of the two work chambers of the adjusting piston from the supply pressure medium, with the aid of the throttles, there is an opportunity for establishing the working pressures in the two work chambers at levels which differ substantially from the supply pressure. Furthermore, the change in pressure in the work chambers is advantageously effected in opposite directions and simultaneously. The adjustment of the adjusting piston can thus take place very quickly. The desired setting of the piston is dependent upon the properties of the restoring spring only to a very limited extent, because on account of the low pressure level in the work chambers in general, the spring is embodied as weaker than in known injection adjusting apparatuses.

The invention will be better understood and further objects and advantages thereof will become more apparent from the ensuing detailed description of preferred embodiments taken in conjunction with the drawings.

Figure 1:
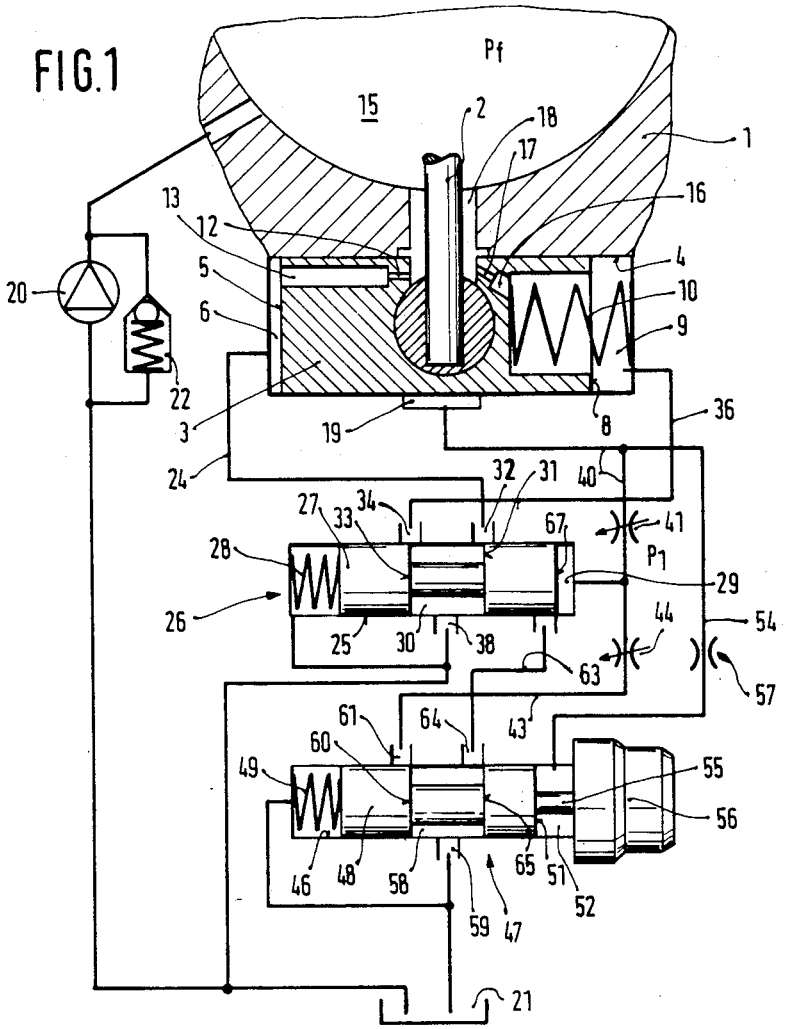
FIG. 1 shows the first exemplary embodiment having an adjustment of the instant of injection toward "early" for cold starting.

An adjusting piston 3 for adjusting the instant of injection onset, such as that known from German Offenlegungsschrift No. 21 58 689 engages the cam drive of the fuel injection pump 1 via a pin 2. The adjusting piston is displaceable tightly within the closed cylinder 4 and there encloses a first work chamber 6 on one end face 5 and the second work chamber 9 on its other end face 8. A restoring spring 10 which tends to keep the adjusting piston 3 in its left-hand outset position is located in the second work chamber 9.

The first work chamber 6 communicates with a suction chamber 15 of the fuel injection pump 1 via a first inflow line 13 containing a throttle 12. In the same manner, the second work chamber 9 communicates with the suction chamber 15 via a second inflow line 16, which contains a throttle 17. This suction chamber 15 communicates with an annular groove 19, located in the middle position of the adjusting piston, in the wall of the closed cylinder via a perforation 18 by means of which the pin 2 is guided. The suction chamber 15 is supplied with fuel from a fuel supply container 21 with the aid of a fuel supply pump 20, and the pressure of the fuel increases in proportion with the rpm with the aid of a pressure control valve 22. A first outflow line 24 leads from the first work chambers 6 into a cylinder 25 of a control valve 26, in which a control slide 27 is displaceable inside the closed cylinder 25 counter to the force of the restoring spring 28. The restoring spring 28 acts upon one end face of the control slide, while a third work chamber 29 is enclosed on the other end face of the control slide in the cylinder 25. The control slide 27 has an annular groove 30, one limiting edge 31 of which controls the inlet cross section 32 of the first outflow line 24 into the cylinder 25. The other limiting edge 33 of the annular groove 30 controls the inlet cross section 34 of a second outflow line 36, which leads from the second work chamber 9 into the cylinder 25. The annular groove 30 communicates continuously with the supply container 21 via an outflow 38.

The third work chamber 29 communicates with the annular groove 19 or with the suction chamber 15 via a pressure line 40. An adjustable throttle 41 is disposed in the pressure line 40, and a relief line 43 leads away from the pressure line 40 downstream of the throttle 41. This relief line 43 also contains an adjustable throttle 44 and discharges into a cylinder 46 of a further control valve 47. The control valve 47 has a piston slide 48, which is tightly displaceable in the cylinder 46 and is acted upon on one end face by a restoring spring 49. The other end face 51 of the piston slide, on the other end, encloses a fourth work chamber 52 within the cylinder 46, this work chamber 52 also communicating continuously with the annular groove 19 or the suction chamber 15 via a connecting line 54. From the end face of the closed cylinder 46 which is opposite the end face 51 of the piston slide, an adjusting pin 55 projects into the fourth work chamber 52 and serves as a stop for the piston slide in its outset position for starting. The adjusting pin 55 is part of an adjusting element 56 functioning in accordance with temperature and ascertaining the engine temperature.

The piston slide 48 likewise has an annular groove 58, which is in continuous communication via an outflow 59 with the fuel supply container 21. One limiting edge 60 of the annular groove 58 serves as the control edge for the inlet opening 61 of the relief line 43 which discharges into the cylinder 46 or into the annular groove 58. An outflow line 63, whose inlet cross section 64 is controlled by the other limiting edge 65 of the annular groove 58, also discharges into the cylinder 46 or, depending upon the position of the piston slide 48, into the annular groove 58. The outflow line 63 branches off from the cylinder 25 of the control valve 26 and is controlled by the end face 67 of the control slide 27 defining the third work chamber 29.

The apparatus described above functions as follows: the fuel supply pump 20, which is driven at pump rpm, furnishes an rpm-dependent fuel pressure to the suction chamber 15 in combination with the pressure control valve 22. The fuel, which is under pressure, passes by way of the throttles 12 and 17 into the first work chamber 6 and the second work chamber 9. In the position of the piston slide 48 of the control valve 47 shown on FIG. 1 which pertains to the cold engine, the piston slide 48 has blocked the inlet opening 61 of the relief line 43, so that the pressure $P_1$ in the third work chamber 29 of the control valve 26 is equally great as the pressure $P_f$ in the suction chamber 15 of the fuel injection pump. This pressure $P_1$ in the third work chamber 29 causes the control slide 28 to be displaced all the way to the left, until the outflow line 63 is opened by the control edge 67, and fuel is capable of flowing out, when the inlet opening 64 is open, to the fuel supply container by way of the annular groove 58 and the outflow 59. The control slide 27 is kept in the left-hand end position in this manner and thereby closes the inlet cross section 32 of the first outflow line 24 and, complementarily thereto, opens the inlet cross section 34 of the second outflow line 36. Accordingly, the pump pressure $P_f$ can build up in the first work chamber 6 while the second work chamber 9 is relieved via the second outflow line 36 toward the annular groove 30, which, in turn, is relieved via the outflow 38 toward the fuel supply container 21. In the second work chamber 9, the uncoupling of the throttle 17 thus establishes a very low fuel pressure, causing the adjusting piston 3 to be displaced toward the right.

In accordance with the displacement of the control slide 27, the inlet cross section 32 and 34 are varied complementarily to one another, and at the same time the pressures in the work chambers 6 and 9 vary as well. In this manner, the movement of the adjusting piston 3 follows the movement of the control slide 27.

With the aid of the control valve 26, it is now possible to influence the position of the adjusting piston 3 in various ways, without regard to the continuously increasing pump supply pressure $P_f$. The control slide 27 of the control valve 26 is exposed for this purpose to a controllable control pressure, which can be varied with the aid of the throttles 41 and 44. By way of the throttle 41, the third work chamber 29 is uncoupled from the pressure of the pressure medium supply in the suction chamber 15, and the degree of coupling is variable, for instance, in accordance with the temperature, or the air pressure or similar parameters, which are capable of affecting the instant of injection. With the aid of the variable throttles 41 and 44, a desired control pressure $P_1$ is thereby established in the third work chamber, and a desired position of the control slide 27 were or of the adjusting piston 3 is correspondingly obtained.

As a peripheral condition, the control pressure $P_1$ can be influenced by the control valve 47 as already discussed. When the engine is cold, $P_1 = P_f$ because the opening 61 is closed. With increasing rpm, $P_f$ also increases so that that pressure increases in the fourth work chamber 52 as well. Beyond a predetermined rpm, the piston slide 48 is then displaced toward the left, as a result of which the relief line 43 can be relieved toward the fuel supply container 21 via the annular groove 58, while the outflow line 63 is simultaneously closed. The control slide 27 accordingly returns to its actual working position for normal operation of the engine, or for normal control of the instant of injection.

Figure 2:
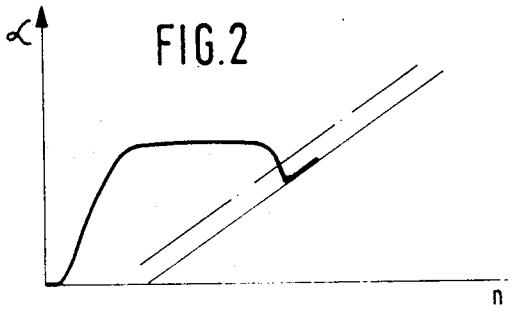
FIG. 2 shows the relationship which can be obtained with the embodiment of FIG. 1 between the instant of injection $\alpha$.

The same success is obtained if after the warming up of the engine the thermostatic adjustment element 56 displaces the piston slide 48 toward the left via the adjusting pin 55. This can also take place below the above-described rpm limit. With the aid of this apparatus, an adjustment of the instant of injection toward "early" is obtained when the engine is cold and only within a predetermined lower rpm range. Beyond a certain limit rpm, even if the engine is not warm, the "normal" injection adjustment, such as that occurring during the operation of the warm engine, is effected. In FIG. 2, this mode of operation is shown in the form of a diagram, where the injection adjustment angle $\alpha$ is plotted over the rpm. The advantage of this apparatus is also that by means of the uncoupling of the first work chamber and second work chamber from the suction work chamber 15, the actuation pressure exerted on the adjusting piston 3 is substantially lower than in known forms of embodiment, so that the restoring spring 10 may also be small in size. In this design, even a very low pump supply pressure is sufficient to cause the injection adjuster to assume its cold-starting position.

Figure 3:
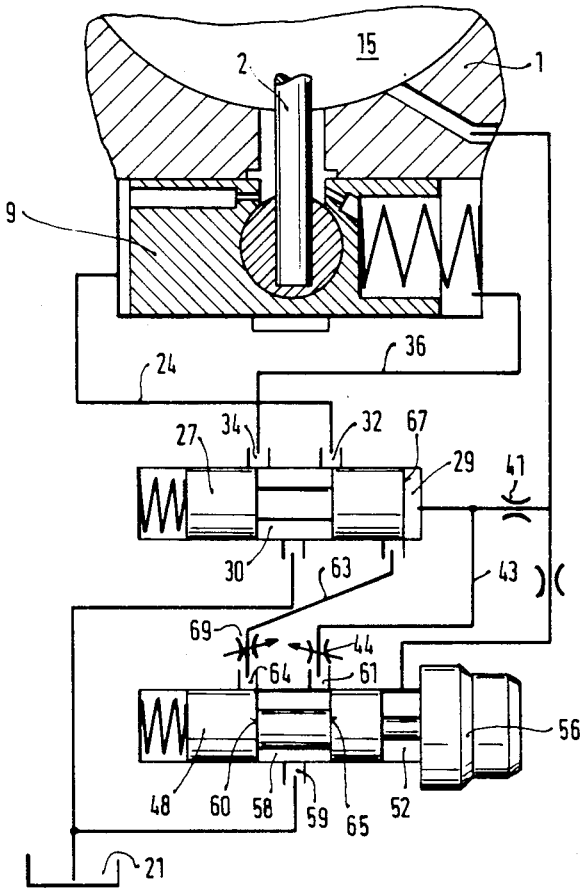
FIG. 3 shows a modified embodiment of the exemplary embodiment of FIG. 1 for adjusting the instant of injection toward "late"

The exemplary embodiment of FIG. 3 corresponds in its mode of operation to the exemplary embodiment of FIG. 1, except that here there is an opportunity to adjust the instant of injection toward "late" when the engine is cold. To this end, the sole change is the direction of adjustment of the piston slide 48, with respect to the inlet openings 61 and 64 of the relief line 43 and the outflow line 63, respectively. While in the exemplary embodiment of FIG. 1 the instant opening 61 of the relief line 43 is controlled by the left-hand limiting edge 60 of the piston slide, this inlet opening 61 is now controlled by the right-hand control edge 65 of the piston slide 48, and the direction of movement and the conditions for adjusting the piston slide 48 are adhered to by means of the control pressure in the fourth work chamber 52 and the temperature-dependent adjusting element 56. The inlet opening 64 of the outflow line 63 is controlled in corresponding fashion by the left-hand control edge 60 of the piston slide 48.

A throttle 69 is further provided in the outflow line 63, which can be varied like the throttle 44 in accordance with operating parameters. In the illustrated position of piston slide 48, with a cold engine, the third work chamber 29 is thus relieved of pressure toward the fuel supply container 21 via the relief line 43, the inlet opening 61 as it opens, the annular groove 58 and the outflow 59. The control slide 27 is thus located in the right-hand position shown in which substantially the inlet opening 32 of the first outflow line 24 is opened into the annular groove 30 and the inlet opening 34 of the second outflow line 36 is closed. The adjusting piston 3 accordingly assumes its left-hand position, corresponding to a late injection instant. If the pump rpm and thus the pump supply pressure $P_f$ increase, then beyond this threshold value the piston slide 48 is displaced toward the left, the inlet opening 61 is closed and the inlet opening 64 is opened. Accordingly, the pressure $P_1$ at first increases within the third work chamber 29 to the pressure $P_f$; as a result of which control slide 27 displaced toward the left and the adjusting piston 3 is displaced toward the right by the complementary variation in the inlet cross sections 32 and 34. After the opening of the outflow line 63 by the end face 67 of the control slide 27, the throttle 69 becomes effective so that a variable control pressure $P_1$ can now be established in the work chamber 29, similarly to the process in the exemplary embodiment of FIG. 1. Beyond this point, the injection instant is displaced, for instance toward "early" with increasing rpm. Opportunities for intervention are provided as in the exemplary embodiment of FIG. 1 by way of the variable throttles 41 and 69.

Figure 4:
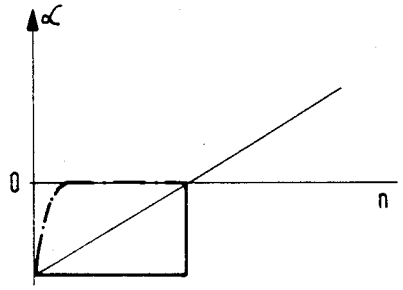
FIG. 4 shows the course of the instant of injection attainable with the embodiment of FIG. 3, plotted over the rpm.

FIG. 4 shows the attainable rotary angle position $\alpha$ of the adjusting piston 3, plotted with respect to the rpm n; depending upon the design of the throttle, and in particular the throttle 44, the curves located below the abscissa n can be obtained.

Figure 5:
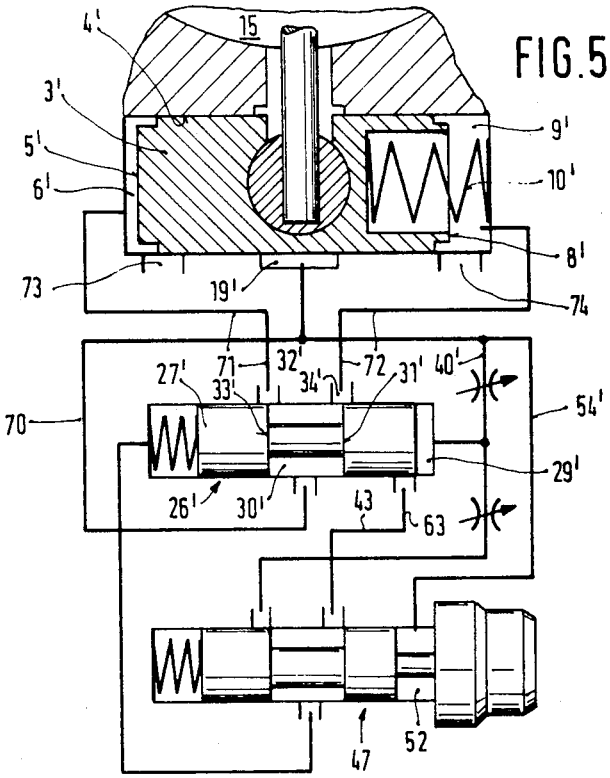
FIG. 5 shows a third exemplary embodiment of the invention in which the adjusting piston of the adjusting apparatus for the instant of injection is embodied as a follower piston.

FIG. 5 shows a third exemplary embodiment of the invention, which differs from the exemplary embodiment of FIG. 1 in that in this third embodiment it is not the outflow of fuel from the first work chamber 6 or second work chamber 9 of the adjusting piston 3 which is controlled by the control valve 26', but the inflow of the pressure medium. Accordingly, a pressure medium line 70, which communicates, for example with the annular groove 19' in the cylinder 4' receiving the adjusting piston 3' discharges into the annular groove 30' of the control slide 27'. Alternatively, the pressure medium line 70 may communicate directly with the pump suction chamber 15. The pressure line 40' which leads to the third work chamber 29' of the pressure control valve 26' and the connecting line 54', which leads to the fourth work chamber 52, are also supplied with fuel by this pressure medium line 70. An inlet opening 32' is controlled by the left-hand limiting edge 33' of the annular groove 30' of the control slide 27', and the inlet opening 32' communicates with the first work chamber 6' in the cylinder 4' via a first inflow line 71. The right-hand limiting edge 31' of the annular groove 30' controls an inlet opening 34' which communicates via a second inflow line 72 with the second work chamber 9' on the other side of the adjusting piston 3' in the cylinder 4'. A first outflow 73 is provided in the cylinder 4' associated with the first end face 5' and controllable by this same first end face 5'. On the other side of the adjusting piston 3', a second outflow opening 74 is provided which is controlled by the second end face 8' and communicates with the second work chamber 9' Depending upon the adjusting direction of the adjusting piston 3, the first outflow opening 73 is opened to a greater or lesser extent upon the displacement of this piston 3', and the second outflow opening 74 is thereby reduced in cross section, and vice versa.

If with increasing pressure in the work chamber 29' the control slide 27' is displaced with the left, then the free cross section of the inlet opening 34' is reduced and the free cross section of the inlet opening 32' is increased in complementary fashion. Accordingly, more fuel flows into the first work chamber 6' so that a higher pressure can be established there. As a result of the pressure increase, the adjusting piston 3' is displaced toward the right counter to the spring 10, until a fuel-balanced pressure is established at the adjusting piston 3' as a result of the opening of the first outflow line 73 and the closing of the second outflow line 74. As a result of the closing of the second outflow line 74 the pressure in the second work chamber 9' is increased, reinforcing the restoring force of spring 10. However, the spring 10 may also be completely omitted in this exemplary embodiment, because a balance of forces can be established solely on the basis of the pressures in the two work chambers 6' and 9' and the adjusting piston 3' practically follows up the movement of the control slide 27'. However, the spring 10' can be provided first for fixing an outset position, and then for generating proportionality in the adjustment of the adjusting piston 3' as well. The control slide 27' is triggered otherwise in the same manner as in the exemplary embodiment of FIG. 1. Accordingly, it is also possible to attain similar dependencies on the part of the injection angle $\alpha$ over the rpm n. The advantage of the present embodiment is, among others, that with a spring 10 embodied as very soft, even very low fuel pressures from the suction chamber 15 are sufficient to cause an adjustment of the adjusting piston 3'.

Figure 6:
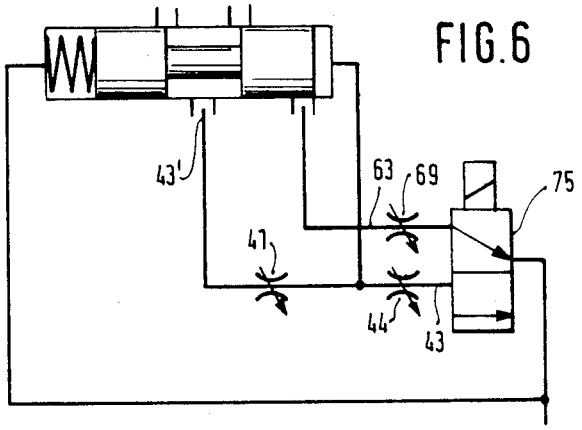
FIG. 6 shows a modified form of embodiment of the exemplary embodiment of FIG. 5.

FIG. 6 shows an alternative form of embodiment, which can also be used in the other exemplary embodiments. Here, instead of the control valve 47, a switch-over valve 75 can be switched into the outflow line 63 or the relief line 43. This valve may be actuated by an electrical control unit, for example, and opens the relief end of either the outflow line 63 or the relief line 43 toward the fuel supply container 21. Furthermore, here as well the pressures can be influenced by way of the throttles 41 and 44 or 69.

The foregoing relates to preferred exemplary embodiments of the invention, it being understood that other embodiments and variants thereof are possible within the spirit and scope of the invention, the latter being defined by the dependent claims.

What is claimed and desired to be secured by Letters Patent of the United States is:

1. A fuel injection pump for an internal combustion engine which comprises:

a pressure medium supply;

pressure control means for varying the pressure of the pressure medium supply in accordance with rpm;

an adjusting piston which is arranged to effect the adjustment of the instant of injection;

a first work chamber adjacent one end of the adjusting piston;

a second work chamber adjacent an opposite end of the adjusting piston;

a first inflow line, including a first inflow throttle, for connecting the first work chamber to the pressure medium supply, and a first outflow line, connected to the first work chamber and including a first outflow throttle, for relieving pressure in the first work chamber, wherein one of the first inflow and outflow throttles is embodied as a first control valve which is actuatable to control the pressure in the first work chamber;

a second inflow line, including a second inflow throttle, for connecting the second work chamber to the pressure medium supply, and a second outflow line, connected to the second work chamber and including a second outflow throttle, for relieving pressure in the second work chamber, wherein one of the second inflow and outflow throttles is embodied as a second control valve which is actuatable to control the pressure in the second work chamber; and valve actuating means for actuating the first and second control valves in a complementary direction relative to one another and in common, in accordance with at least one operating parameter.

2. A fuel injection pump, as described in claim 1, wherein the first and second inflow throttles are embodied as the first and second control valves, respectively.

3. A fuel injection pump, as described in claim 1, wherein the first and second outflow throttles are embodied as the first and second control valves, respectively.

4. A fuel injection pump for an internal combustion engine which comprises:

a pressure medium supply;

pressure control means for varying the pressure of the pressure medium supply in accordance with rpm;

an adjusting piston which is arranged to effect the adjustment of the instant of injection;

a first work chamber adjacent one end of said adjusting piston;

a second work chamber adjacent an opposite end of said adjusting piston;

a first inflow line, including a first inflow throttle, for connecting said first work chamber to the pressure medium supply, and a first outflow line, connected to said first work chamber and including a first outflow throttle, for relieving pressure in said first work chamber, wherein one of said first inflow and outflow throttles is embodied as a first control valve which is actuatable to control the pressure in said first work chamber;

said first control valve including a first flowthrough cross section of the line to said first work chamber that includes said first control valve, and a first valve closing member that is actuable to control the first flowthrough cross section, a second inflow line, including a second inflow throttle, for connecting said second work chamber to the pressure medium supply, and a second outflow line, connected to said second work chamber and including a second outflow throttle, for relieving pressure in said second work chamber, wherein one of said second inflow and outflow throttles is embodied as a second control valve which is actuatable to control the pressure in said second work chamber;

said second control valve including a second flowthrough cross section of the line to said second work chamber which includes said second control valve, and a second valve closing member that is actuatable to control the second flowthrough cross section; and valve actuating means for actuating said first and second control valves in a complementary direction relative to one another and in common, in accordance with at least operating ing parameter;

said valve actuating means including a servomotor which is connected to said first and second valve closing members and which includes a third work chamber, pressure supply means for supplying a control pressure to said third work chamber, and a third control valve for varying the control pressure in said third work chamber.

5. A fuel injection pump, as described in claim 4, wherein the servomotor further comprises:

a control slide having a first end closing the third work chamber, an opposite second end, and a circumferential surface which defines first and second control edges and an annular groove extending between the two control edges intermediate control slide ends, wherein the first control edge constitutes the first valve closing member and the second control edge constitutes the second valve closing member; and spring means for exerting a force on the second end of the control slide in opposition to the force exerted on the first end of the control slide by the control pressure in the third work chamber.

6. A fuel injection pump, as described in claim 5, which further comprises a third outflow line connected to the third work chamber and wherein the control slide further comprises a third control edge formed by the first end of the control slide for controlling the flowthrough cross section of the opening of the third outflow line into the third work chamber, the third outflow line including a further flowthrough cross section which is controlled by the third control valve.

7. A fuel injection pump, as described in claim 6, wherein the pressure supply means for supplying the control pressure to the third work chamber includes a pressure line connecting the third work chamber with the pressure medium supply.

8. A fuel injection pump, as described in claim 7, which further comprises:

a throttle which is disposed in the pressure line; and a relief line which is connected to the pressure line downstream of the pressure line throttle and which is controllable by the third control valve.

9. A fuel injection pump, as described in claim 8, wherein the third control valve includes a closing member which is actuatable to simultaneously close the third outflow line and open the relief line.

10. A fuel injection pump, as described in claim 9, wherein the closing member of the third control valve is embodied as a piston slide which is displaceable counter to a restoring spring and has a continuously relieved annular groove with two limiting edges which respectively control the relief line and the third outflow line discharging into the annular groove, the piston slide having a piston face which closes a fourth work chamber which continuously communicates with the pressure medium supply via a connecting line.

11. A fuel injection pump, as described in claim 10, wherein the third control valve includes a temperature-dependent adjusting element which acts on the piston face of the piston slide to hold the piston slide in a terminal position, counter to the force of the restoring spring, when the engine is warm.

12. A fuel injection pump, as described in claim 8, which further comprises a throttle disposed in the relief line.

13. A fuel injection pump, as described in claim 6, which further comprises a throttle disposed in the third outflow line.

14. A fuel injection pump, as described in claim 10, which further comprises a throttle disposed in the connecting line.

15. A fuel injection pump, as described in claim 12, wherein the throttle in the relief line is a variable throttle and the injection pump further comprises control means for varying the relief line throttle in accordance with at least one operating parameter.

16. A fuel injection pump as described in claim 15, which further comprises a throttle disposed in the third outflow line and a throttle disposed in the connecting line.

17. A fuel injection pump, as described in claim 8, 15, or 16, wherein the throttle in the pressure line is a variable throttle and the injection pump further comprises control means for varying the pressure line throttle in accordance with at least one operating parameter.

18. A fuel injection pump, as described in claim 5, wherein:

the fuel injection pump further comprises a pressure medium line by which the annular groove of the control slide forming the first and second control valves communicates continuously with the pressure medium supply;

the first and second inflow lines extend from the annular groove of the control slide to the first and second work chambers, respectively, and are controlled in cross section by the first and second control edges of the control slide in accordance with the position of the control slide; and the adjusting piston includes a first end face edge and a second end face edge which are arranged to control outflow cross sections of the first and second outflow lines, respectively, in complementary fashion to one another.

* * * * *